US010351932B2

(12) United States Patent
Horie

(10) Patent No.: US 10,351,932 B2
(45) Date of Patent: Jul. 16, 2019

(54) COPPER-TITANIUM ALLOY FOR ELECTRONIC COMPONENT

(71) Applicant: JX Nippon Mining & Metals Corporation, Tokyo (JP)

(72) Inventor: Hiroyasu Horie, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 384 days.

(21) Appl. No.: 15/108,338

(22) PCT Filed: Sep. 11, 2014

(86) PCT No.: PCT/JP2014/074126
§ 371 (c)(1),
(2) Date: Jun. 27, 2016

(87) PCT Pub. No.: WO2015/098201
PCT Pub. Date: Jul. 2, 2015

(65) Prior Publication Data

US 2016/0326611 A1 Nov. 10, 2016

(30) Foreign Application Priority Data

Dec. 27, 2013 (JP) ..... 2013-272845

(51) Int. Cl.
*C22C 9/00* (2006.01)
*C22F 1/08* (2006.01)
(Continued)

(52) U.S. Cl.
CPC ..... *C22C 9/00* (2013.01); *C22F 1/08* (2013.01); *H01B 1/026* (2013.01); *C22F 1/00* (2013.01)

(58) Field of Classification Search
CPC ..... C22C 9/00; C22F 1/08; H01B 1/026
See application file for complete search history.

(56) References Cited

U.S. PATENT DOCUMENTS

2004/0219054 A1 11/2004 Sugawara et al.

FOREIGN PATENT DOCUMENTS

CN 102453810 A 5/2012
JP 2004-176163 A 6/2004
(Continued)

OTHER PUBLICATIONS

International Preliminary Report on Patentability and Written Opinion (English Translation) for International Application No. PCT/JP2014/074126, dated Jul. 7, 2016.
(Continued)

*Primary Examiner* — Colin W. Slifka
(74) *Attorney, Agent, or Firm* — Marshall, Gerstein & Borun LLP

(57) ABSTRACT

The present invention controls the fluctuations of Ti concentration in a copper titanium alloy from a perspective different from conventional perspectives to improve the strength and bending workability of the copper titanium alloy. A copper titanium alloy for electronic components comprising 2.0 to 4.0 mass % of Ti, and 0 to 0.5 mass %, in total, of one or more elements selected from the group consisting of Fe, Co, Mg, Si, Ni, Cr, Zr, Mo, V, Nb, Mn, B, and P as a third element, with the balance being copper and unavoidable impurities, wherein a coefficient of variation in a Ti concentration fluctuation curve is 0.2 to 0.8, the Ti concentration fluctuation curve being obtained when Ti in a matrix phase for <100>-oriented crystal grains in a cross section parallel to a rolling direction is subjected to line analysis by EDX, and in structure observation of a cross section parallel to the rolling direction, a number of second-phase particles having a size of 3 μm or more per an observation field of view of 10000 $\mu m^2$ is 35 or less.

6 Claims, 1 Drawing Sheet

(51) Int. Cl.
*H01B 1/02* (2006.01)
*C22F 1/00* (2006.01)

(56) References Cited

FOREIGN PATENT DOCUMENTS

| | | | |
|---|---|---|---|
| JP | 2004-231985 | A | 8/2004 |
| JP | 2005-097638 | A | 4/2005 |
| JP | 2006-265611 | A | 10/2006 |
| JP | 2012-012631 | A | 1/2012 |
| JP | 2012-077338 | A | 4/2012 |
| JP | 2012097306 | A | 5/2012 |
| JP | 2012/207254 | A | 10/2012 |
| JP | 2012188680 | A | 10/2012 |
| JP | 2013/209731 | A | 10/2013 |
| JP | 2014084512 | A | 5/2014 |
| JP | 2014084514 | A | 5/2014 |
| JP | 2015098622 | A | 5/2015 |
| TW | 201217550 | A | 5/2012 |
| WO | WO-2014/064969 | A1 | 5/2014 |
| WO | WO-2014/064970 | A1 | 5/2014 |

OTHER PUBLICATIONS

Extended European Search Report in EP Application No. 14873824.8 dated May 29, 2017, 10 pages.
Search Report in International Application No. PCT/JP2014/074126 dated Dec. 9, 2014, 4 pages.
Office Action in JP Application No. 2013-272845 dated Dec. 2, 2014, 2 pages.
Office Action in Taiwan Application No. 10420967340 dated Jul. 22, 2015, 3 pages.

[Figure 1]
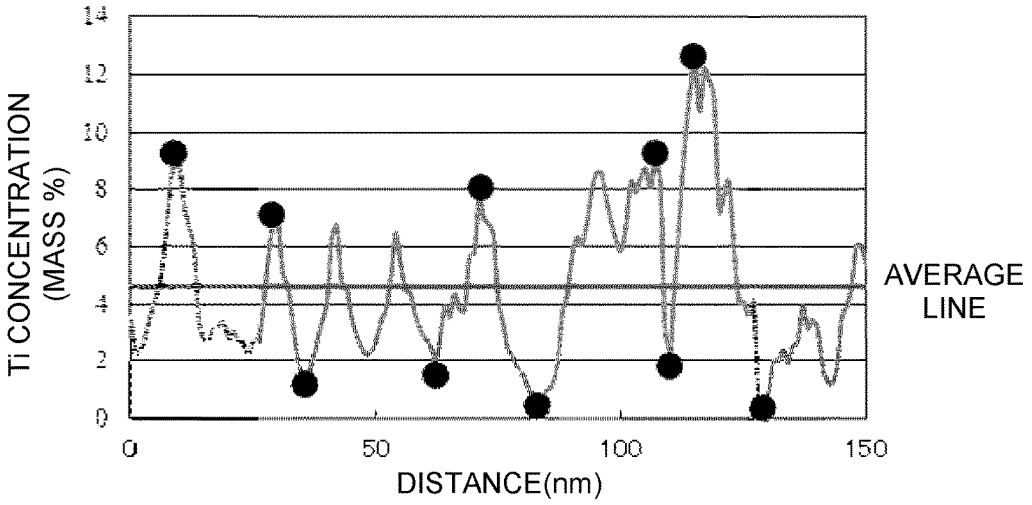
[Figure 2]
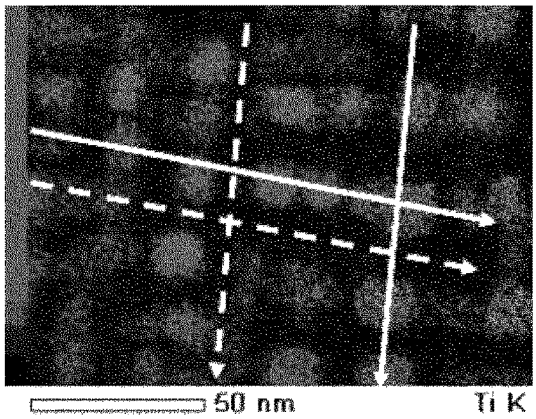

COPPER-TITANIUM ALLOY FOR ELECTRONIC COMPONENT

TECHNICAL FIELD

The present invention relates to copper titanium alloy preferred as a member for electronic components such as a connector.

BACKGROUND ART

In recent years, the miniaturization of electronic equipment typified by portable terminals and the like has advanced increasingly, and therefore connectors used in it have a significant tendency to a narrower pitch, lower height, and narrower width. A smaller connector has narrower pin width and a small folded work shape, and therefore high strength for obtaining necessary spring properties is required of the member used. In this respect, a copper alloy containing titanium (hereinafter referred to as "copper titanium alloy") has relatively high strength and has the most excellent stress relaxation properties among copper alloys and therefore has been used from old times as a member for a signal system terminal of which strength is particularly required.

The copper titanium alloy is an age-hardenable copper alloy. When a supersaturated solid solution of Ti that is a solute atom is formed by solution treatment, and heat treatment is performed from the state at low temperature for a relatively long time, a modulation structure that is periodical fluctuations of Ti concentration develops in the matrix phase by spinodal decomposition, and the strength improves. At this time, the problem is that strength and bending workability are conflicting properties. In other words, when the strength is improved, the bending workability is impaired, and on the contrary, when the bending workability is regarded as important, the desired strength is not obtained. Generally, as the draft of cold rolling is increased, introduced dislocations increase, and the dislocation density increases, and therefore nucleation sites contributing to precipitation increase, and the strength after aging treatment can be increased. But, when the draft is increased too much, the bending workability worsens. Therefore, achieving both strength and bending workability has been considered as a problem.

Therefore, techniques are proposed in which attempts are made to achieve both the strength and bending workability of the copper titanium alloy from the perspectives of adding third elements such as Fe, Co, Ni, and Si (Patent Literature 1), restricting the concentration of a group of impurity elements dissolved in a matrix phase and precipitating these as second-phase particles (Cu—Ti—X-based particles) in a predetermined distribution form to increase the regularity of a modulation structure (Patent Literature 2), prescribing slight amounts of added elements effective in making crystal grains finer and the density of second-phase particles (Patent Literature 3), making crystal grains finer (Patent Literature 4), controlling crystal orientation (Patent Literature 5), and the like.

In addition, in Patent Literature 6, it is described that as a titanium modulation structure due to spinodal decomposition develops, the fluctuations of titanium concentration increase, and thus tenacity is given to a copper titanium alloy, and the strength and the bending workability improve. Therefore, in Patent Literature 6, a technique of controlling the fluctuations of Ti concentration in a matrix phase due to spinodal decomposition is proposed. In Patent Literature 6, it is described that after final solution treatment, heat treatment (under aging treatment) is introduced to previously induce spinodal decomposition, and then cold rolling at a conventional level and aging treatment at a conventional level or aging treatment with a lower temperature and a shorter time than those of the aging treatment at a conventional level are performed to increase the fluctuations of Ti concentration and achieve higher strength of a copper titanium alloy.

CITATION LIST

Patent Literature

Patent Literature 1: Japanese Patent Laid-Open No. 2004-231985

Patent Literature 2: Japanese Patent Laid-Open No. 2004-176163

Patent Literature 3: Japanese Patent Laid-Open No. 2005-97638

Patent Literature 4: Japanese Patent Laid-Open No. 2006-265611

Patent Literature 5: Japanese Patent Laid-Open No. 2012-188680

Patent Literature 6: Japanese Patent Laid-Open No. 2012-097306

SUMMARY OF INVENTION

Technical Problem

In this manner, conventionally, many efforts have been made to improve properties in terms of both strength and bending workability, but due to the miniaturization of electronic equipment, the miniaturization of mounted electronic components such as connectors also proceeds further. In order to follow such a technical trend, it is necessary to achieve the strength and bending workability of a copper titanium alloy at higher levels. It is shown that increasing the fluctuations of Ti concentration due to spinodal decomposition is effective in the improvement of the balance between strength and bending workability, but there is still room for improvement.

Therefore, it is an object of the present invention to control the fluctuations of Ti concentration in a copper titanium alloy from a perspective different from conventional perspectives to improve the strength and bending workability of the copper titanium alloy.

Solution to Problem

The present inventor has found that a coefficient of variation and further a ten-point average height in a Ti concentration fluctuation curve obtained by a line analysis of Ti concentration in the matrix phase of a copper titanium alloy by EDX significantly influence strength and bending workability. The present inventor has found that the balance between these properties can be improved by suitably controlling these parameters. The present invention has been completed with the above findings as a background and is specified by the following.

In one aspect, the present invention is a copper titanium alloy for electronic components comprising 2.0 to 4.0 mass % of Ti, 0 to 0.5 mass %, in total, of one or more elements selected from the group consisting of Fe, Co, Mg, Si, Ni, Cr, Zr, Mo, V, Nb, Mn, B, and P as a third element, and a balance comprising copper and unavoidable impurities, wherein a coefficient of variation in a Ti concentration fluctuation curve is 0.2 to 0.8, the Ti concentration fluctuation curve being obtained when Ti in a matrix phase for <100>-oriented crystal grains in a cross section parallel to a rolling direction is subjected to line analysis by EDX, and a number of second-phase particles having a size of 3 μm or more per an observation field of view of 10000 $\mu m^2$ in structure observation of a cross section parallel to the rolling direction is 35 or less.

In one embodiment of the copper titanium alloy according to the present invention, a ten-point average height in a Ti concentration fluctuation curve is 2.0 to 17.0 mass %, the Ti concentration fluctuation curve being obtained when Ti in a matrix phase for <100>-oriented crystal grains in a cross section parallel to the rolling direction is subjected to line analysis by EDX.

In another embodiment of the copper titanium alloy according to the present invention, an average crystal grain size in structure observation of a cross section parallel to the rolling direction is 2 to 30 μm.

In still another embodiment of the copper titanium alloy according to the present invention, 0.2% proof stress in a direction parallel to the rolling direction is 900 MPa or more, and no cracks are formed in a bent portion when a Badway (a bending axis is in the same direction as the rolling direction) W bending test is carried out with a bending width that meets sheet width (w)/sheet thickness (t)=3.0 and with bending radius (R)/sheet thickness (t)=0.

In another aspect, the present invention is a wrought copper alloy product comprising the copper titanium alloy according to the present invention.

In still another aspect, the present invention is an electronic component comprising the copper titanium alloy according to the present invention.

Advantageous Effects of Invention

According to the present invention, copper titanium alloy having an improved balance between strength and bending workability is obtained. By using the copper titanium alloy according to the present invention as a material, an electronic component such as a connector having high reliability is obtained.

BRIEF DESCRIPTION OF DRAWINGS

FIG. 1 is one example of a Ti concentration fluctuation curve obtained when Ti in the matrix phase of the copper titanium alloy according to the present invention is subjected to line analysis by EDX.

FIG. 2 is an example of a mapping image of Ti in the matrix phase of the copper titanium alloy.

DESCRIPTION OF EMBODIMENTS (1) Ti Concentration

In the copper titanium alloy according to the present invention, the Ti concentration is 2.0 to 4.0 mass %. In the copper titanium alloy, the strength and the electrical conductivity are increased by dissolving Ti in a Cu matrix by solution treatment and dispersing fine precipitates in the alloy by aging treatment.

When the Ti concentration is less than 2.0 mass %, the fluctuations of Ti concentration do not occur or decrease, and the precipitation of precipitates is insufficient, and the desired strength is not obtained. When the Ti concentration is more than 4.0 mass %, the bending workability deteriorates, and the material is likely to crack in rolling. Considering the balance between strength and bending workability, a preferred Ti concentration is 2.5 to 3.5 mass %.

(2) Third Element

In the copper titanium alloy according to the present invention, the strength can be further improved by containing one or more third elements selected from the group consisting of Fe, Co, Mg, Si, Ni, Cr, Zr, Mo, V, Nb, Mn, B, and P. However, when the total concentration of the third elements is more than 0.5 mass %, the bending workability deteriorates, and the material is likely to crack in rolling. Therefore, 0 to 0.5 mass %, in total, of these third elements can be contained, and considering the balance between strength and bending workability, 0.1 to 0.4 mass % of one or more of the above elements is preferably contained in the total amount.

(3) Coefficient of Variation and Ten-Point Average Height in Ti Concentration Fluctuation Curve In the present invention, the coefficient of variation and ten-point average height in a Ti concentration fluctuation curve are obtained by a line analysis of Ti in the matrix phase for <100>-oriented crystal grains in a cross section parallel to the rolling direction by EDX. The Ti concentration fluctuation curve is specifically prepared by energy-dispersive X-ray spectroscopy (EDX) using a scanning transmission electron microscope (STEM) for a cross section parallel to the rolling direction (STEM-EDX analysis). When the matrix phase for <100>-oriented crystal grains in the copper titanium alloy is subjected to line analysis by STEM-EDX analysis, a state in which the Ti concentration changes periodically as shown in FIG. 1 can be observed. The average line shown in FIG. 1 represents a value (average value) obtained by dividing the total value of Ti concentrations (mass %) at measurement points measured through a line analysis by the number of measurement points. Further, the coefficient of variation and ten-point average height of Ti concentration (mass %) can be measured from the Ti concentration fluctuation curve as shown in FIG. 1.

The coefficient of variation of Ti concentration is a value calculated by the coefficient of variation=standard deviation/the average value by calculating the standard deviation and average value of Ti concentration within the measurement distance of measured data. A large coefficient of variation indicates a large change in Ti concentration, and a small coefficient of variation indicates a small change in Ti concentration.

The ten-point average height of Ti concentration is defined as the sum of the average value of the absolute values of the heights of the highest peak to the fifth peak (Yp) and the average value of the absolute values of the heights of the lowest valley to the fifth valley (Yv) based on the average line within the measurement distance of measured data. For example, in FIG. 1, the peak values marked with circle marks are used for the calculation of the ten-point average height. The absolute values of the heights of the highest peak to the fifth peak are 4.53, 2.31, 3.20, 4.41, and 7.88 in order from the left side of the graph, and their average value is 4.466. In addition, the absolute values of the heights of the lowest valley to the fifth valley are 3.10, 2.60, 3.80, 2.30, and 4.10 in order from the left side of the graph, and their average value is 3.186. Therefore, the ten-point average height in this case is obtained as 7.652 mass %.

The measurement distance is 150 nm or more from the perspective of preventing measurement errors. The same analysis is repeated five times in different observation fields of view, and the average values are the measured values of the coefficient of variation and the ten-point average height.

In line analysis, the fluctuation state of Ti concentration differs greatly depending on the analysis direction. This is because Ti-concentrated portions are regularly arranged at intervals of several tens of nm. Therefore, before line analysis is performed, Ti mapping is previously performed, and line analysis is performed aiming at a region where the density contrast of Ti increases. Line analysis is preferably carried out in the direction of an arrow (solid line) from Ti mapping as shown in FIG. 2. In addition, when line analysis is performed in the direction of an arrow (dotted line), the density contrast of Ti decreases, which is not preferred.

One of the features of the present invention is that the coefficient of variation of Ti concentration in the matrix phase of the copper titanium alloy is large. Thus, it is considered that tenacity is given to the copper titanium alloy, and the strength and the bending workability improve. In one embodiment of the copper titanium alloy according to the present invention, the coefficient of variation in the Ti concentration fluctuation curve described above is 0.2 or more, preferably 0.25 or more, more preferably 0.3 or more, and still more preferably 0.35 or more.

However, when the coefficient of variation of Ti concentration (mass %) in the matrix phase is too large, coarse second-phase particles are likely to precipitate, and on the contrary, the strength and the bending workability tend to decrease. Therefore, in one embodiment of the copper titanium alloy according to the present invention, the coefficient of variation in the Ti concentration fluctuation curve described above is 0.8 or less, preferably 0.7 or less, more preferably 0.6 or less, and still more preferably 0.5 or less.

The ten-point average height of Ti concentration correlates with the coefficient of variation of Ti concentration to some extent, and a tendency is seen that as the coefficient of variation increases, the ten-point average height also increases. However, further improvement of the balance between strength and bending workability can be expected by suitably controlling not only the coefficient of variation but the ten-point average height. Considering the balance between strength and bending workability, the ten-point average height of Ti concentration (mass %) in the matrix phase is preferably 2.0 mass % or more, more preferably 4.0 mass % or more, and still more preferably 5.0 mass % or more. In addition, the ten-point average height of Ti concentration (mass %) in the matrix phase is preferably 17.0 mass % or less, more preferably 15.0 mass % or less, and still more preferably 13.0 mass % or less.

(4) Second-Phase Particles

Another feature of the copper titanium alloy according to the present invention is that although the coefficient of variation of Ti concentration is large, the amount of coarse second-phase particles is small. Since the coarse second-phase particles adversely affect the strength and the bending workability, it is preferred to control the coarse second-phase particles, and in combination with the effect with the property improvement due to the preferred coefficient of variation, a copper titanium alloy having significantly excellent strength and bending workability is obtained. In the present invention, the second-phase particles refer to crystallized products formed in the solidification process of melting and casting and precipitates formed in subsequent cooling process, precipitates formed in a cooling process after hot rolling, precipitates formed in a cooling process after solution treatment, and precipitates formed in an aging treatment process and typically have a Cu—Ti-based composition. The size of the second-phase particles is defined as the diameter of the maximum circle that can be surrounded by the precipitates when a cross section parallel to the rolling direction is subjected to structure observation in observation by an electron microscope.

In one embodiment of the copper titanium alloy according to the present invention, the number of second-phase particles having a size of 3 μm or more per an observation field of view of 10000 $\mu m^2$ is 35 or less. The number of second-phase particles having a size of 3 μm or more per an observation field of view of 10000 $\mu m^2$ is preferably 30 or less, more preferably 25 or less, still more preferably 20 or less, still more preferably 15 or less, and still more preferably 10 or less. The number of second-phase particles having a size of 3 μm or more per an observation field of view of 10000 $\mu m^2$ is desirably 0, but is generally 1 or more, typically 3 or more, because it is difficult to keep the coefficient of variation within the prescribed range.

(5) 0.2% Proof Stress and Bending Workability

In one embodiment of the copper titanium alloy according to the present invention, the 0.2% proof stress in a direction parallel to the rolling direction is 900 MPa or more when the tensile test according to JIS-Z2241 is performed, and no cracks are formed in a bent portion when a Badway (the bending axis is in the same direction as the rolling direction) W bending test is carried out according to JIS-H3130 with a bending width that meets sheet width (w)/sheet thickness (t)=3.0 and with bending radius (R)/sheet thickness (t)=0.

In one preferred embodiment of the copper titanium alloy according to the present invention, the 0.2% proof stress in a direction parallel to the rolling direction is 1000 MPa or more when the tensile test according to JIS-Z2241 is performed, and no cracks are formed in a bent portion when a Bad way (the bending axis is in the same direction as the rolling direction) W bending test is carried out according to JIS-H3130 with a bending width that meets sheet width (w)/sheet thickness (t)=3.0 and with bending radius (R)/sheet thickness (t)=0.

In one more preferred embodiment of the copper titanium alloy according to the present invention, the 0.2% proof stress in a direction parallel to the rolling direction is 1050 MPa or more when the tensile test according to JIS-Z2241 is performed, and no cracks are formed in a bent portion when a Badway (the bending axis is in the same direction as the rolling direction) W bending test is carried out according to JIS-H3130 with a bending width that meets sheet width (w)/sheet thickness (t)=3.0 and with bending radius (R)/sheet thickness (t)=0.

In one still more preferred embodiment of the copper titanium alloy according to the present invention, the 0.2% proof stress in a direction parallel to the rolling direction is 1100 MPa or more when the tensile test according to JIS-Z2241 is performed, and no cracks are formed in a bent portion when a Bad way (the bending axis is in the same direction as the rolling direction) W bending test is carried out according to JIS-H3130 with a bending width that meets sheet width (w)/sheet thickness (t)=3.0 and with bending radius (R)/sheet thickness (t)=0.

The upper limit value of the 0.2% proof stress is not particularly restricted in terms of the strength targeted by the present invention. But, since effort and cost are required, and moreover there is a risk of cracking during hot rolling when the Ti concentration is increased in order to obtain high strength, the 0.2% proof stress of the copper titanium alloy according to the present invention is generally 1400 MPa or less, typically 1300 MPa or less, and more typically 1200 MPa or less.

(6) Crystal Grain Size

In order to improve the strength and bending workability of the copper titanium alloy, smaller crystal grains are better. Therefore, a preferred average crystal grain size is 30 μm or less, more preferably 20 μm or less, and still more preferably 10 μm or less. The lower limit is not particularly limited, but when an attempt is made to make the crystal grains finer to the extent that the distinction of crystal grain size is difficult, mixed grains in which unrecrystallized grains are present form, and therefore, on the contrary, the bending workability is likely to worsen. Therefore, the average crystal grain size is preferably 2 μm or more. In the present invention, the average crystal grain size is represented by a circle-equivalent diameter in the structure observation of a cross section parallel to the rolling direction in observation by an optical microscope or an electron microscope.

(7) Sheet Thickness of Copper Titanium Alloy

In one embodiment of the copper titanium alloy according to the present invention, the sheet thickness can be 0.5 mm or less. In a typical embodiment, the thickness can be 0.03 to 0.3 mm. In a more typical embodiment, the thickness can be 0.08 to 0.2 mm.

(8) Applications

The copper titanium alloy according to the present invention can be worked into various wrought copper alloy products, for example, sheets, strips, tubes, rods, and lines. The copper titanium alloy according to the present invention can be preferably used as a material of electronic components such as connectors, switches, autofocus camera modules, jacks, terminals (for example, battery terminals), and relays though this is not limiting.

(9) Manufacturing Method

The copper titanium alloy according to the present invention can be manufactured by carrying out suitable heat treatment and cold rolling particularly in final solution treatment and the subsequent steps. Specifically, the copper titanium alloy according to the present invention can be manufactured by making heat treatment after final solution treatment two-stage heat treatment for the copper titanium alloy manufacturing procedure, final solution treatment→heat treatment (under aging treatment)→cold rolling→aging treatment, described in Patent Literature 6. A preferred manufacturing example will be sequentially described below for each step.

<Ingot Manufacturing>

The manufacturing of an ingot by melting and casting is basically performed in a vacuum or in an inert gas atmosphere. Undissolved residues of the added elements in the melting do not act effectively on the improvement of strength. Thus, in order to eliminate the undissolved residues, a high-melting point third element such as Fe or Cr needs to be held for a certain time after being added and then sufficiently stirred. On the other hand, Ti dissolves relatively easily in Cu and therefore should be added after the melting of the third element. Therefore, an ingot is desirably manufactured by adding one or two or more elements selected from the group consisting of Fe, Co, Mg, Si, Ni, Cr, Zr, Mo, V, Nb, Mn, B, and P to Cu so that 0 to 0.5 mass %, in total, of the one or two or more elements are contained, and then adding Ti so that 2.0 to 4.0 mass % of Ti is contained.

<Homogenizing and Hot Rolling>

The solidification segregation and crystallized products produced during the ingot manufacturing are coarse and therefore are desirably dissolved in the matrix phase and made small as much as possible and eliminated as much as possible in homogenizing because this is effective in the prevention of bending cracks. Specifically, after the ingot manufacturing step, it is preferred that the ingot is heated to 900 to 970° C., and homogenizing is performed for 3 to 24 hours, and then hot rolling is carried out. In order to prevent liquid metal brittleness, the temperature is preferably 960° C. or less before the hot rolling and during the hot rolling and 900° C. or more in a pass from the original thickness to a total draft of 90%.

<First Solution Treatment>

Then, it is preferred that cold rolling and annealing are appropriately repeated, and then first solution treatment is performed. The reason why solution treatment is previously performed here is that the burden on final solution treatment is reduced. In other words, in the final solution treatment, rather than heat treatment for dissolving the second-phase particles, a solution is already made, and therefore only recrystallization should be induced while the state is maintained, and therefore light heat treatment is sufficient. Specifically, the first solution treatment should be performed at a heating temperature of 850 to 900° C. for 2 to 10 minutes. The temperature increase rate and cooling rate at this time are also preferably increased as much as possible so that the second-phase particles do not precipitate here. The first solution treatment need not be performed.

<Intermediate Rolling>

As the draft in intermediate rolling before the final solution treatment is increased, recrystallized grains in the final solution treatment can be controlled to be uniform and fine. Therefore, the draft of the intermediate rolling is preferably 70 to 99%. The draft is defined by {((thickness before rolling−thickness after rolling)/thickness before rolling)×100%}.

<Final Solution Treatment>

In the final solution treatment, the precipitates are desirably completely dissolved, but when the material is heated to high temperature until the precipitates are completely eliminated, the crystal grains are likely to coarsen, and therefore the heating temperature is a temperature around the solid solubility limit of the second-phase particle composition (the temperature at which the solid solubility limit of Ti is equal to the amount of Ti added is about 730 to 840° C. when the amount of Ti added is in the range of 2.0 to 4.0 mass %, and, for example, about 800° C. when the amount of Ti added is 3.0 mass %). When the material is rapidly heated to this temperature, and the cooling rate is also increased by water cooling or the like, the production of the coarse second-phase particles is suppressed. Therefore, the material is typically heated to a temperature that is −20° C. to +50° C. with respect to the temperature at which the solid solubility limit of Ti is the same as the amount of Ti added, 730 to 840° C., and more typically heated to a temperature 0 to 30° C., preferably 0 to 20° C., higher than the temperature at which the solid solubility limit of Ti is the same as the amount of Ti added, 730 to 840° C.

In addition, the coarsening of the crystal grains can be suppressed when the heating time in the final solution treatment is shorter. The heating time can be, for example, 30 seconds to 10 minutes, typically 1 minute to 8 minutes. Even if the second-phase particles are produced at this point of time, they are almost harmless to the strength and the bending workability when finely and uniformly dispersed. But, coarse ones tend to grow further in final aging treatment, and therefore the second-phase particles at this point of time must be reduced and made small as much as possible even if produced.

<Pre-Aging>

Following the final solution treatment, pre-aging treatment is performed. Conventionally, cold rolling is usually performed after the final solution treatment, but in order to obtain the copper titanium alloy according to the present invention, it is important that after the final solution treatment, pre-aging treatment is immediately performed without performing cold rolling. The pre-aging treatment is heat treatment performed at a lower temperature than aging treatment at the next step. By continuously performing the pre-aging treatment and the aging treatment described later, the coefficient of variation of Ti concentration in the matrix phase of the copper titanium alloy can be dramatically increased while the production of coarse precipitates is suppressed. The pre-aging treatment is preferably performed in an inert atmosphere such as Ar, N2, or H2 in order to suppress the production of a surface oxide film.

It is difficult to obtain the above advantage whether the heating temperature in the pre-aging treatment is too low or too high. According to the results of studies by the present inventor, the material is preferably heated at a material temperature of 150 to 250° C. for 10 to 20 hours, more preferably heated at a material temperature of 160 to 230° C. for 10 to 18 hours, and still more preferably heated at 170 to 200° C. for 12 to 16 hours.

<Aging Treatment>

Following the pre-aging treatment, the aging treatment is performed. After the pre-aging treatment, the material may be cooled to room temperature once. Considering manufacturing efficiency, it is desirable that after the pre-aging treatment, the temperature is increased to aging treatment temperature without cooling to continuously carry out the aging treatment. With either method, there is no difference in the properties of the obtained copper titanium alloy. However, the pre-aging is intended to uniformly precipitate the second-phase particles in subsequent aging treatment, and therefore cold rolling should not be carried out between the pre-aging treatment and the aging treatment.

A small amount of Ti dissolved in the solution treatment precipitates by the pre-aging treatment, and therefore the aging treatment should be carried out at a slightly lower temperature than usual aging treatment, and the material is preferably heated at a material temperature of 300 to 450° C. for 0.5 to 20 hours, more preferably heated at a material temperature of 350 to 440° C. for 2 to 18 hours, and still more preferably heated at a material temperature of 375 to 430° C. for 3 to 15 hours. The aging treatment is preferably performed in an inert atmosphere such as Ar, N2, or H2 for the same reason as the pre-aging treatment.

<Final Cold Rolling>

After the above aging treatment, final cold rolling is performed. The strength of the copper titanium alloy can be increased by the final cold working, but in order to obtain a good balance between high strength and bending workability as intended by the present invention, it is desirable that the draft is 10 to 50%, preferably 20 to 40%.

<Stress Relief Annealing>

From the perspective of improving settling resistance during high-temperature exposure, it is desired that after the final cold rolling, stress relief annealing is carried out because the dislocations are rearranged by performing the stress relief annealing. The conditions of the stress relief annealing may be common conditions, but when excessive stress relief annealing is performed, coarse particles precipitate, and the strength decreases, which is not preferred. The stress relief annealing is preferably performed at a material temperature of 200 to 600° C. for 10 to 600 seconds, more preferably performed at 250 to 550° C. for 10 to 400 seconds, and still more preferably performed at 300 to 500° C. for 10 to 200 seconds.

Those skilled in the art could understand that steps such as grinding, polishing, and shot blasting pickling for the removal of the oxide scale on the surface can be appropriately performed between the above steps.

EXAMPLES

Examples (Inventive Examples) of the present invention will be shown below together with Comparative Examples. These are provided for better understanding of the present invention and advantages thereof and are not intended to limit the invention.

Test pieces of copper titanium alloys containing alloy components shown in Table 1 (Tables 1-1 and 1-2) with the balance comprising copper and unavoidable impurities were made under various manufacturing conditions, and the coefficient of variation of Ti concentration and the ten-point average height obtained when Ti in the matrix phase of each test piece was subjected to line analysis by EDX, and further the 0.2% proof stress and the bending workability were examined.

First, 2.5 kg of electrolytic copper was melted in a vacuum melting furnace, and third elements were respectively added in blending proportions shown in Table 1, and then Ti in a blending proportion shown in the same table was added. The holding time after the addition was also sufficiently considered so that there were no undissolved residues of the added elements, and then the mixture was injected into a mold in an Ar atmosphere to manufacture about 2 kg of an ingot.

After homogenizing in which the above ingot was heated at 950° C. for 3 hours, hot rolling was performed at 900 to 950° C. to obtain a hot-rolled sheet having a sheet thickness of 15 mm. After scale removal by facing, the hot-rolled sheet was subjected to cold rolling to provide the sheet thickness of a crude strip (2 mm), and primary solution treatment with the crude strip was performed. The conditions of the primary solution treatment were heating at 850° C. for 10 minutes, and then water cooling was performed. Then, intermediate cold rolling was performed with the draft adjusted according to the conditions of a draft in final cold rolling and product sheet thickness described in Table 1, and then the material was inserted into an annealing furnace capable of rapid heating and subjected to final solution treatment and then water-cooled. The heating conditions at this time were as described in Table 1 with the material temperature based on a temperature at which the solid solubility limit of Ti was the same as the amount of Ti added (about 800° C. at a Ti concentration of 3.0 mass %, about 730° C. at a Ti concentration of 2.0 mass %, about 840° C. at a Ti concentration of 4.0 mass %). Then, pre-aging treatment and aging treatment were continuously performed in an Ar atmosphere under conditions described in Table 1. Here, cooling was not performed after the pre-aging treatment. After scale removal by pickling, final cold rolling was performed under conditions described in Table 1, and lastly stress relief annealing was performed under heating conditions described in Table 1 to provide each of the test pieces of the Inventive Examples and the Comparative Examples. The pre-aging treatment, the aging treatment, or the stress relief annealing was omitted depending on the test piece.

For the product samples made, the following evaluations were performed.

(A) 0.2% Proof Stress

A JIS No. 13B test piece was made, and for this test piece, the 0.2% proof stress in a direction parallel to the rolling direction was measured according to JIS-Z2241 using a tensile tester.

(B) Bending Workability

A Bad way (the bending axis was in the same direction as the rolling direction) W bending test was carried out according to JIS-H3130 with a bending width that was sheet width (w)/sheet thickness (t)=3.0, and the minimum bending radius ratio (MBR/t) that was the ratio of the minimum bending radius (MBR) at which no cracks occurred to thickness (t) was obtained. At this time, the presence or absence of cracks was determined by whether or not cracks occurred in the bent portion when a bent portion cross section was mirror-finished by mechanical polishing and observed by an optical microscope.

(C) STEM-EDX Analysis

For each test piece, a rolled surface was cut with a focused ion beam (FIB) to expose a cross section parallel to the rolling direction, and the sample was worked thin to a sample thickness of about 100 nm or less. Then, a <100>-oriented grain was identified by EBSD, and the interior of the matrix phase of the crystal grain was observed. A <100>-oriented crystal grain is observed because the density contrast of Ti concentration is the highest. The observation was performed with a sample tilt angle of 0°, an acceleration voltage of 200 kV, and an electron beam spot diameter of 0.2 nm by using a scanning transmission electron microscope (JEOL Ltd., model: JEM-2100F) and using an energy-dispersive X-ray analyzer (EDX, manufactured by JEOL Ltd., model: JED-2300) for the detector. Then, EDX line analysis was performed with the measurement distance of the matrix phase: 150 nm, the number of measurement points per the measurement distance of the matrix phase, 150 nm: 150 points, and the intervals between the measurement points of the matrix phase: 1 nm. In order to prevent measurement errors due to the influence of the second-phase particle, an arbitrary position at which no second-phase particle was present was selected for the measurement position of the matrix phase. In addition, for the direction of the line analysis, Ti mapping was previously performed, and a direction in which the density contrast of Ti concentration increased was selected according to the solid lines in FIG. 2.

The coefficient of variation of Ti concentration and the ten-point average height were obtained from the obtained Ti concentration fluctuation curve according to the previously described methods.

(D) Crystal Grain Size

In addition, for the measurement of the average crystal grain size of each product sample, a rolled surface was cut with an FIB to expose a cross section parallel to the rolling direction, and then the cross section was observed using an electron microscope (manufactured by Philips, XL30 SFEG), the number of crystal grains per unit area was counted, and the average circle-equivalent diameter of the crystal grains was obtained. Specifically, a 100 μm×100 μm frame was made, and the number of crystal grains present within this frame was counted. Crystal grains crossing the frame were all counted as ½. The area of the frame, 10000 $\mu m^2$, divided by their total is the average value of the area per crystal grain. The diameter of a true circle having the area is the circle-equivalent diameter, and therefore this was determined as the average crystal grain size.

(E) Number Density of Coarse Second-Phase Particles

A rolled surface of each product sample was cut with an FIB to expose a cross section parallel to the rolling direction, and then the cross section was observed using an electron microscope (manufactured by Philips, XL30 SFEG), and according to the previously described definition, the number of second-phase particles having a size of 3 μm or more present within an area of 10000 $\mu m^2$ was counted, and the average of the numbers at 10 arbitrary points was obtained.

(Discussions)

The test results are shown in Table 1 (Tables 1-1 and 1-2). It is seen that in Inventive Example 1, the conditions of the final solution treatment, the pre-aging, the aging, and the final cold rolling were appropriate, and therefore the coefficient of variation of Ti concentration increased, and on the other hand, the coarse second-phase particles are suppressed, and both the 0.2% proof stress and the bending workability are achieved at high levels.

In Inventive Example 2, the heating temperature of the pre-aging was lower than in Inventive Example 1, and therefore the coefficient of variation of Ti concentration decreased. The 0.2% proof stress decreased compared with Inventive Example 1, but good 0.2% proof stress and bending workability were still ensured.

In Inventive Example 3, the heating temperature of the pre-aging was higher than in Inventive Example 1, and therefore the coefficient of variation of Ti concentration increased. The 0.2% proof stress decreased compared with Inventive Example 1, but the balance between good 0.2% proof stress and bending workability was still maintained.

In Inventive Example 4, the heating temperature of the aging was lower than in Inventive Example 1, and therefore the coefficient of variation of Ti concentration decreased. The 0.2% proof stress decreased compared with Inventive Example 1, but good 0.2% proof stress and bending workability were still ensured.

In Inventive Example 5, the heating temperature of the aging was higher than in Inventive Example 1, and therefore the coefficient of variation of Ti concentration increased. The 0.2% proof stress decreased compared with Inventive Example 1, but good 0.2% proof stress and bending workability were still ensured.

In Inventive Example 6, the draft in the final cold rolling was smaller than in Inventive Example 1, and therefore the 0.2% proof stress decreased more than in Inventive Example 1, but good 0.2% proof stress and bending workability were still ensured.

In Inventive Example 7, the draft in the final cold rolling was higher than in Inventive Example 1, and therefore the 0.2% proof stress improved while high bending workability was maintained.

In Inventive Example 8, the stress relief annealing was omitted with respect to Inventive Example 1, but good 0.2% proof stress and bending workability were still ensured.

In Inventive Example 9, the heating temperature in the stress relief annealing was increased with respect to Inventive Example 1, but good 0.2% proof stress and bending workability were still ensured.

In Inventive Example 10, the heating temperatures in the pre-aging, the aging, and the stress relief annealing were higher than in Inventive Example 1, and therefore the coefficient of variation of Ti concentration and the ten-point average height increased. The ten-point average height was outside the prescribed range, and therefore the 0.2% proof stress was poorer than in Inventive Example 1, but good 0.2% proof stress and bending workability were still ensured.

Inventive Example 11 is an example in which the Ti concentration in the copper titanium alloy was decreased to the lower limit with respect to Inventive Example 1. The coefficient of variation of Ti concentration decreased, and a decrease in 0.2% proof stress was seen, but good 0.2% proof stress and bending workability were still ensured.

Inventive Example 12 is an example in which the Ti concentration in the copper titanium alloy was increased to the upper limit with respect to Inventive Example 1, and therefore the 0.2% proof stress increased more than in Inventive Example 1.

Inventive Examples 13 to 18 are examples in which various third elements were added with respect to Inventive Example 1. Good 0.2% proof stress and bending workability were still ensured.

In Comparative Example 1, the final solution treatment temperature was too low, and therefore the formation of mixed grains in which unrecrystallized regions and recrystallized regions were mixed occurred, and the coefficient of variation of Ti concentration decreased. Therefore, the bending workability was poor.

In Comparative Example 2, the pre-aging treatment was not performed, and therefore an increase in the coefficient of variation of Ti concentration was insufficient, and the bending workability was poor.

Comparative Examples 3 to 4 correspond to the copper titanium alloy described in Patent Literature 6. The pre-aging treatment and the aging treatment were not continuously performed, and therefore an increase in the coefficient of variation of Ti concentration was insufficient, and the bending workability was poor.

In Comparative Example 5, the pre-aging treatment was performed, but the heating temperature was too low, and therefore the coefficient of variation of Ti concentration did not increase sufficiently, and the bending workability was poor.

In Comparative Example 6, the heating temperature in the pre-aging was too high, and therefore over aging occurred, and the coefficient of variation of Ti concentration increased excessively, and some stable phases that could not withstand the fluctuations precipitated as coarse particles. Therefore, the bending workability decreased.

In Comparative Example 7, the aging treatment was not performed, and therefore spinodal decomposition was insufficient, and the coefficient of variation of Ti concentration decreased. Therefore, the 0.2% proof stress and the bending workability decreased with respect to Inventive Example 1.

Comparative Example 8 is a case that can be evaluated as final solution treatment→cold rolling→aging treatment being performed. The coefficient of variation of Ti concentration fell within the prescribed range, but the precipitation of the coarse second-phase particles increased, and therefore the 0.2% proof stress and the bending workability decreased with respect to Inventive Example 1.

In Comparative Example 9, the heating temperature of the aging was too low, and therefore the coefficient of variation of Ti concentration decreased, and the 0.2% proof stress and the bending workability decreased with respect to Inventive Example 1.

In Comparative Example 10, the heating temperature of the aging was too high, and therefore over aging occurred, and the coefficient of variation of Ti concentration increased excessively, and some stable phases that could not withstand the fluctuations precipitated as coarse particles. Therefore, the 0.2% proof stress and the bending workability decreased with respect to Inventive Example 1.

In Comparative Example 11, the heating temperature of the stress relief annealing was too high, and therefore the coefficient of variation of Ti concentration increased excessively, and some stable phases that could not withstand the fluctuations precipitated as coarse particles. Therefore, the 0.2% proof stress and the bending workability decreased with respect to Inventive Example 1.

Comparative Example 12 is an example in which after the final solution treatment, only the aging treatment was performed. A large number of the coarse second-phase particles precipitated. Therefore, the 0.2% proof stress and the bending workability decreased with respect to Inventive Example 1.

In Comparative Example 13, the amounts of the third elements added were too large, and therefore cracks occurred in the hot rolling, and therefore a test piece could not be manufactured.

In Comparative Example 14, the Ti concentration was too low, and therefore the coefficient of variation of Ti concentration decreased, and the strength was insufficient, and the bending workability also deteriorated.

In Comparative Example 15, the Ti concentration was too high, and therefore cracks occurred in the hot rolling, and therefore a test piece could not be manufactured.

TABLE 1-1

| | Components (mass %) | | Final solution treatment | Pre-aging | Aging | Final rolling | Stress relief annealing |
|---|---|---|---|---|---|---|---|
| Example | Ti | Third elements | Conditions | Conditions | Conditions | Draft (%) | Conditions |
| Inventive Example 1 | 3.2 | — | 820° C. × 2.5 min | 200° C. × 14 h | 400° C. × 7 h | 30 | 400° C. × 60 s |
| Inventive Example 2 | 3.2 | — | 820° C. × 2.5 min | 150° C. × 20 h | 400° C. × 7 h | 30 | 400° C. × 60 s |
| Inventive Example 3 | 3.2 | — | 820° C. × 2.5 min | 250° C. × 10 h | 400° C. × 7 h | 30 | 400° C. × 60 s |
| Inventive Example 4 | 3.2 | — | 820° C. × 2.5 min | 200° C. × 14 h | 300° C. × 20 h | 30 | 400° C. × 60 s |
| Inventive Example 5 | 3.2 | — | 820° C. × 2.5 min | 200° C. × 14 h | 450° C. × 3 h | 30 | 400° C. × 60 s |
| Inventive Example 6 | 3.2 | — | 820° C. × 2.0 min | 200° C. × 14 h | 400° C. × 7 h | 10 | 400° C. × 60 s |
| Inventive Example 7 | 3.2 | — | 820° C. × 3.5 min | 200° C. × 14 h | 400° C. × 7 h | 50 | 400° C. × 60 s |
| Inventive Example 8 | 3.2 | — | 820° C. × 2.5 min | 200° C. × 14 h | 400° C. × 7 h | 30 | — |
| Inventive Example 9 | 3.2 | — | 820° C. × 2.5 min | 200° C. × 14 h | 400° C. × 7 h | 30 | 650° C. × 60 s |
| Inventive Example 10 | 3.2 | — | 820° C. × 2.5 min | 250° C. × 10 h | 450° C. × 3 h | 30 | 650° C. × 60 s |
| Inventive Example 11 | 2.0 | — | 770° C. × 2.5 min | 200° C. × 14 h | 360° C. × 7 h | 30 | 400° C. × 60 s |
| Inventive Example 12 | 4.0 | — | 850° C. × 2.5 min | 200° C. × 14 h | 440° C. × 7 h | 30 | 400° C. × 60 s |
| Inventive Example 13 | 3.2 | 0.1Ni—0.05Si | 840° C. × 1.5 min | 200° C. × 14 h | 350° C. × 7 h | 30 | 350° C. × 60 s |
| Inventive Example 14 | 3.2 | 0.1Zr—0.1Mg—0.1V | 850° C. × 2.5 min | 200° C. × 14 h | 400° C. × 7 h | 30 | 400° C. × 60 s |
| Inventive Example 15 | 3.2 | 0.2Mn—0.1Mg—0.1P | 830° C. × 5.0 min | 250° C. × 10 h | 400° C. × 7 h | 30 | 400° C. × 60 s |
| Inventive Example 16 | 3.2 | 0.2Fe—0.05Nb | 840° C. × 7.0 min | 200° C. × 14 h | 450° C. × 7 h | 30 | 400° C. × 60 s |
| Inventive Example 17 | 3.2 | 0.2Mo—0.05Cr | 840° C. × 2.0 min | 150° C. × 20 h | 400° C. × 10 h | 20 | 300° C. × 60 s |
| Inventive Example 18 | 3.2 | 0.2Co—0.05B | 850° C. × 2.5 min | 200° C. × 14 h | 400° C. × 7 h | 40 | 250° C. × 60 s |
| Comparative Example 1 | 3.2 | — | 700° C. × 2.5 min | 200° C. × 14 h | 400° C. × 7 h | 30 | 400° C. × 60 s |

TABLE 1-1-continued

| Example | Components (mass %) Ti | Components (mass %) Third elements | Final solution treatment Conditions | Pre-aging Conditions | Aging Conditions | Final rolling Draft (%) | Stress relief annealing Conditions |
|---|---|---|---|---|---|---|---|
| Comparative Example 2 | 3.2 | — | 820° C. × 2.5 min | — | 400° C. × 7 h | 30 | 400° C. × 60 s |
| Comparative Example 3 | 3.2 | — | 820° C. × 2.5 min | — | 350° C. × 3 h | 30 | 380° C. × 7 h |
| Comparative Example 4 | 3.2 | — | 820° C. × 2.5 min | — | 550° C. × 30 s | 30 | 350° C. × 7 h |
| Comparative Example 5 | 3.2 | — | 820° C. × 2.5 min | 100° C. × 25 h | 400° C. × 7 h | 30 | 400° C. × 60 s |
| Comparative Example 6 | 3.2 | — | 820° C. × 2.5 min | 300° C. × 12 h | 400° C. × 7 h | 30 | 400° C. × 60 s |
| Comparative Example 7 | 3.2 | — | 820° C. × 2.5 min | 200° C. × 14 h | — | 30 | 400° C. × 60 s |
| Comparative Example 8 | 3.2 | — | 820° C. × 2.5 min | — | — | 30 | 400° C. × 7 h |
| Comparative Example 9 | 3.2 | — | 820° C. × 2.5 min | 200° C. × 14 h | 250° C. × 25 h | 30 | 400° C. × 60 s |
| Comparative Example 10 | 3.2 | — | 820° C. × 2.5 min | 200° C. × 14 h | 500° C. × 1 h | 30 | 400° C. × 60 s |
| Comparative Example 11 | 3.2 | — | 820° C. × 2.5 min | 200° C. × 14 h | 400° C. × 7 h | 30 | 650° C. × 60 s |
| Comparative Example 12 | 3.2 | — | 820° C. × 2.5 min | — | 425° C. × 7 h | — | — |
| Comparative Example 13 | 3.2 | 0.3B—0.2Mn—0.1Mg | Impossible to manufacture | | | | |
| Comparative Example 14 | 1.5 | — | 745° C. × 2.5 min | 200° C. × 14 h | 400° C. × 7 h | 30 | 400° C. × 60 s |
| Comparative Example 15 | 4.5 | — | Impossible to manufacture | | | | |

TABLE 1-2

| Example | Final properties: Crystal grain size (μm) | Product sheet thickness (mm) | 0.2% Proof stress (MPa) | Bending width (mm) | MBR/t (—) | Spinodal decomposition: Coefficient of variation (—) | Ten-point average height (mass %) | Coarse second-phase particles Number Density (number/10000 μm$^2$) |
|---|---|---|---|---|---|---|---|---|
| Inventive Example 1 | 8 | 0.100 | 1049 | 0.30 | 0 | 0.45 | 6.5 | 12 |
| Inventive Example 2 | 8 | 0.100 | 1021 | 0.30 | 0 | 0.31 | 5.1 | 6 |
| Inventive Example 3 | 6 | 0.100 | 1014 | 0.30 | 0 | 0.52 | 8.1 | 18 |
| Inventive Example 4 | 7 | 0.100 | 1005 | 0.30 | 0 | 0.35 | 4.2 | 10 |
| Inventive Example 5 | 9 | 0.100 | 1011 | 0.30 | 0 | 0.58 | 10.5 | 24 |
| Inventive Example 6 | 10 | 0.100 | 921 | 0.30 | 0 | 0.41 | 5.7 | 17 |
| Inventive Example 7 | 8 | 0.100 | 1141 | 0.30 | 0 | 0.63 | 8.4 | 24 |
| Inventive Example 8 | 11 | 0.100 | 1010 | 0.30 | 0 | 0.41 | 7.0 | 14 |
| Inventive Example 9 | 10 | 0.100 | 1023 | 0.30 | 0 | 0.54 | 8.8 | 18 |
| Inventive Example 10 | 9 | 0.100 | 981 | 0.30 | 0 | 0.61 | 18.5 | 31 |
| Inventive Example 11 | 15 | 0.100 | 974 | 0.30 | 0 | 0.24 | 2.2 | 3 |
| Inventive Example 12 | 17 | 0.100 | 1052 | 0.30 | 0 | 0.74 | 15.8 | 32 |
| Inventive Example 13 | 10 | 0.050 | 1051 | 0.15 | 0 | 0.40 | 8.1 | 20 |
| Inventive Example 14 | 12 | 0.100 | 1069 | 0.30 | 0 | 0.55 | 9.7 | 26 |
| Inventive Example 15 | 4 | 0.200 | 1074 | 0.60 | 0 | 0.52 | 10.9 | 27 |
| Inventive Example 16 | 5 | 0.300 | 1064 | 0.90 | 0 | 0.67 | 13.2 | 33 |
| Inventive Example 17 | 28 | 0.100 | 1032 | 0.30 | 0 | 0.44 | 6.4 | 19 |
| Inventive Example 18 | 25 | 0.100 | 1028 | 0.30 | 0 | 0.49 | 5.3 | 8 |
| Comparative Example 1 | Unrecrystallized | 0.100 | 1051 | 0.30 | 5.0 | 0.11 | 1.7 | 5 |
| Comparative Example 2 | 5 | 0.100 | 1034 | 0.30 | 1.5 | 0.15 | 4.1 | 40 |
| Comparative Example 3 | 6 | 0.100 | 1012 | 0.30 | 2.0 | 0.16 | 3.8 | 44 |
| Comparative Example 4 | 5 | 0.100 | 1025 | 0.30 | 2.0 | 0.18 | 5.0 | 42 |
| Comparative Example 5 | 8 | 0.100 | 1054 | 0.30 | 1.5 | 0.14 | 5.1 | 48 |
| Comparative Example 6 | 8 | 0.100 | 1036 | 0.30 | 2.0 | 0.87 | 19.1 | 54 |
| Comparative Example 7 | 7 | 0.100 | 891 | 0.30 | 1.0 | 0.12 | 1.5 | 21 |
| Comparative Example 8 | 10 | 0.100 | 951 | 0.30 | 1.0 | 0.23 | 1.8 | 38 |
| Comparative Example 9 | 4 | 0.100 | 911 | 0.30 | 1.0 | 0.16 | 4.3 | 7 |
| Comparative Example 10 | 8 | 0.100 | 909 | 0.30 | 1.0 | 0.84 | 18.5 | 37 |
| Comparative Example 11 | 8 | 0.100 | 967 | 0.30 | 2.5 | 0.81 | 17.5 | 44 |
| Comparative Example 12 | 10 | 0.100 | 651 | 0.30 | 0.5 | 0.51 | 7.2 | 41 |
| Comparative Example 13 | Impossible to manufacture | | | | | | | |
| Comparative Example 14 | 20 | 0.100 | 833 | 0.30 | 1.0 | 0.12 | 0.9 | 2 |
| Comparative Example 15 | Impossible to manufacture | | | | | | | |

The invention claimed is:

1. A copper titanium alloy for electronic components comprising 2.0 mass % to 4.0 mass % of Ti, and 0 mass % to 0.5 mass %, in total, of one or more elements selected from the group consisting of Fe, Co, Mg, Si, Ni, Cr, Zr, Mo, V, Nb, Mn, B, and P as a third element, with the balance being copper and unavoidable impurities, wherein a coefficient of variation in a Ti concentration fluctuation curve is 0.2 to 0.8, the Ti concentration fluctuation curve being obtained when Ti in a matrix phase for <100>-oriented crystal grains in a cross section parallel to a rolling direction is subjected to line analysis by EDX, and in structure observation of a cross section parallel to the rolling direction, a number of second-phase particles having a size of 3 μm or more per an observation field of view of 10000 μm$^2$ is 35 or less.

2. The copper titanium alloy according to claim 1, wherein a ten-point average height in a Ti concentration fluctuation curve is 2.0 mass % to 17.0 mass %, the Ti concentration fluctuation curve being obtained when Ti in a matrix phase for <100>-oriented crystal grains in a cross section parallel to the rolling direction is subjected to line analysis by EDX.

3. The copper titanium alloy according to claim 1, wherein in structure observation of a cross section parallel to the rolling direction, an average crystal grain size is 2 μm to 30 μm.

4. The copper titanium alloy according to claim 1, wherein 0.2% proof stress in a direction parallel to the rolling direction is 900 MPa or more, and no cracks are formed in a bent portion when a Bad way (a bending axis is in the same direction as the rolling direction) W bending test is carried out with a bending width that meets sheet width (w)/sheet thickness (t)=3.0 and with bending radius (R)/sheet thickness (t)=0.

5. A wrought copper alloy product comprising the copper titanium alloy according to claim 1.

6. An electronic component comprising the copper titanium alloy according to claim 1.

* * * * *